US005898589A

United States Patent [19]

Shakespeare et al.

[11] Patent Number: 5,898,589

[45] Date of Patent: Apr. 27, 1999

[54] METHOD AND EQUIPMENT FOR DEFINING CROSS-DIRECTIONAL PROPERTIES OF SHEET IN CONTINUOUS SHEET MAKING PROCESS

[75] Inventors: John Shakespeare, Siuro; Juha Kniivilä, Tampere, both of Finland

[73] Assignee: Valmet Automation Inc., Helsinki, Finland

[21] Appl. No.: 08/971,863

[22] Filed: Nov. 17, 1997

[51] Int. Cl.[6] ..... G06F 19/00

[52] U.S. Cl. ..... 364/471.03; 73/159; 162/198; 364/471.01

[58] Field of Search ..... 364/471.01–471.03, 364/469.01, 469.03, 469.04; 162/198, 49, 252, 253, 254, 262, 263; 73/159

[56] References Cited

U.S. PATENT DOCUMENTS

| | | | |
|---|---|---|---|
| 5,122,963 | 6/1992 | Chen | 364/471 |
| 5,400,258 | 3/1995 | He | 364/471 |
| 5,539,634 | 7/1996 | He | 364/158 |
| 5,603,806 | 2/1997 | Kerttula | 162/198 |
| 5,636,126 | 6/1997 | Heaven et al. | 364/471.03 |
| 5,658,432 | 8/1997 | Heaven et al. | 162/198 |

*Primary Examiner*—Reba I. Elmore
*Assistant Examiner*—Steven R. Garland
*Attorney, Agent, or Firm*—Ladas & Parry

[57] ABSTRACT

The invention relates to a method and an equipment for defining the cross-directional properties of a sheet in a continuous sheet making process. According to the invention, the set point profile of the actuators affecting the cross-directional properties of the sheet is defined, high frequencies are filtered from the defined profile, and shrinkage nonlinearity is deduced from the filtered profile without modulating or stimulating the actuators.

13 Claims, 2 Drawing Sheets

METHOD AND EQUIPMENT FOR DEFINING CROSS-DIRECTIONAL PROPERTIES OF SHEET IN CONTINUOUS SHEET MAKING PROCESS

The invention relates to a method of defining the cross-directional properties of a sheet in a continuous sheet making process.

The invention further relates to an equipment for defining the cross-directional properties of a sheet in a continuous sheet making process, the equipment comprising actuators for adjusting the cross-directional properties of the sheet.

In a continuous sheet making process, it is common to employ an array of actuators deployed at plural locations across the sheet making apparatus in order to control properties of sheet in the cross machine direction. Said controlled properties are commonly measured at a different point in the machine, normally downstream from the actuators. The controlled properties are measured at plural locations across the sheet, but these locations need not correspond to the actuator locations either in number or placement across the sheet making apparatus.

In general, the sheet deforms to some extent in passing from the actuation system to the measurement system. Usually there is shrinkage in the cross machine direction, but expansion may occur in some processes. This shrinkage or expansion may not be uniform across the sheet, being more pronounced at some locations than at others. Moreover, the sheet may drift to some extent towards either side of the machine when passing from the actuation system to the measurement system. These deformations vary and, in combination, lead to a variable and often non-linear relation between positions in the cross machine direction at the actuation system and at the measurement system. This relation is commonly referred to as mapping.

Mapping is presently determined by deviating from normal procedures in controlling an actuator affecting the cross-dimensional profile of the sheet either momentarily or continuously. The cross-directional profile of the sheet is then measured and the point subjected to said disturbance is defined. Mapping is thereafter defined, often by using quite complex algorithms. This solution is known from e.g. U.S. Pat. Nos. 5,122,963, 5,400,258, and 5,539,634. All these cases involve some disturbance to the process, and bump tests, for example, are laborious, because they are not automated and cause marks in the sheet and complex algorithms lead to excessive use of computer resources. Further these methods require the use of a measuring frame an thereby a massive and complex system for defining mapping.

U.S. Pat. No. 5,658,432 discloses a method for determining the cross-machine shrinkage or expansion profile of a travelling sheet produced in a sheet-making machine between an upstream location and a downstream location. The method involves marking the sheet at the upstream location with an array of marks at measured, predetermined intervals in the cross-machine direction. The sheet is inspected in the cross-machine direction at the down-stream location to measure the spacing of the array of marks. A shrinkage or expansion profile of the travelling sheet is developed based on the changes in the spacing between the array of marks at the downstream location. Marking the sheet debases the quality of the paper and therefore this method cannot be used for determining shrinkage profile of fine paper, for example. Further the determined profile is only a sample and the process must be repeated regularly. Also this method requires a massive and complex measuring and processing system.

It is the object of the present invention to provide a method and an equipment for avoiding the drawbacks in present solutions. The method of the invention is characterized by defining the set point profile of the actuators affecting the cross-directional properties of the sheet, filtering high frequencies from the profile, and deducing shrinkage nonlinearity from the filtered profile.

The equipment of the invention is characterized in that it comprises means for defining the set point profile of the actuators, means for filtering high frequencies from the set point profile, and means for deducing shrinkage nonlinearity from the filtered set point profile.

The essential idea of the invention is that the actuator set point profile is defined, high frequencies are filtered from the defined profile, and shrinkage nonlinearity is deduced from the filtered profile. It is the idea of a preferred embodiment that the mapping is deduced from the shrinkage nonlinearity.

It is an advantage of the invention that the shrinkage nonlinearity can be detected without modulating or stimulating the actuators for that purpose and without the need for any observations of measured sheet properties. The shrinkage nonlinearity and mapping nonlinearity can be inferred from steady state configurations of the actuators. The method is very simple and does not rely on sophisticated calculation or skilled personnel. The invention does not require or use any measurements of web properties.

BRIEF DESCRIPTION OF THE DRAWINGS

The invention will be described in greater detail in the attached drawings, in which.

DETAILED DESCRIPTION OF THE INVENTION

Figure 1:
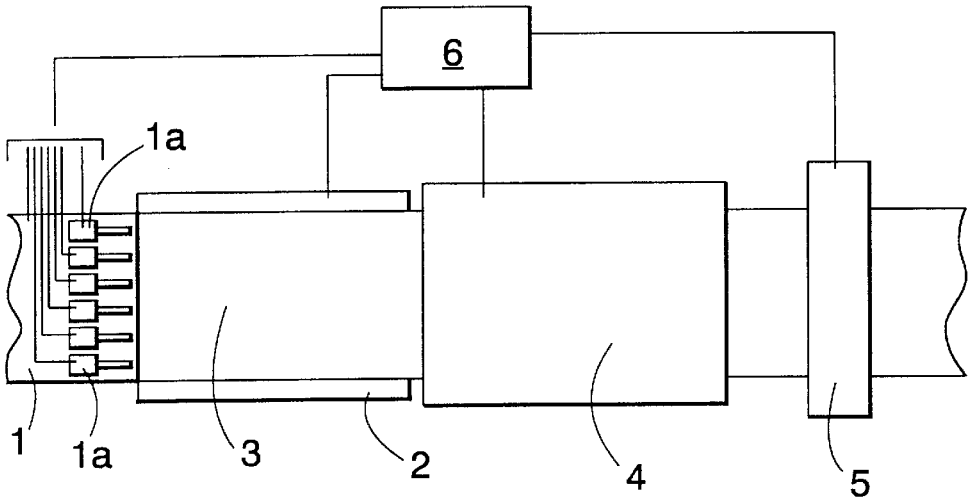
FIG. 1 is a schematic top view of a part of a paper or board machine, FIG. 2 schematically shows an actuator set point profile.

FIG. 1 is a schematic top view of a part of a paper or board machine. Paper and board manufacturing processes are an example of a continuous sheet making process. A paper machine comprises a headbox 1, from which pulp is fed into a former 2 in which a fiber web 3 is formed of the pulp. The headbox 1 comprises e.g. actuators 1*a* for adjusting the position of the slice lip at different points so as to affect the cross-directional properties of the fiber web 3. A small portion of the web 3 is commonly trimmed off at each edge of the web 3, between the headbox 1 and the drying section 4. The fiber web 3 is dried in a drying section 4 after which a measuring frame 5 is arranged for measuring the machine-direction and cross-directional properties of the fiber web 3 in a manner known per se. A paper machine further comprises e.g. a press section and a reel, and possibly also e.g. size presses or a calender, not shown in FIG. 1 for the sake of clarity. Furthermore, the operation of a paper machine is fully known per se to those skilled in the art and is therefore not described in any more detail here.

The equipment further comprises a control unit 6 for assembling data concerning the fiber web 3 and the adjustments and operating statuses of the different parts of the paper machine. On the basis of the assembled data, the control unit controls the different parts and actuators of the paper machine, such as the actuators 1*a* for adjusting the slice of the head box 1.

Figure 2:
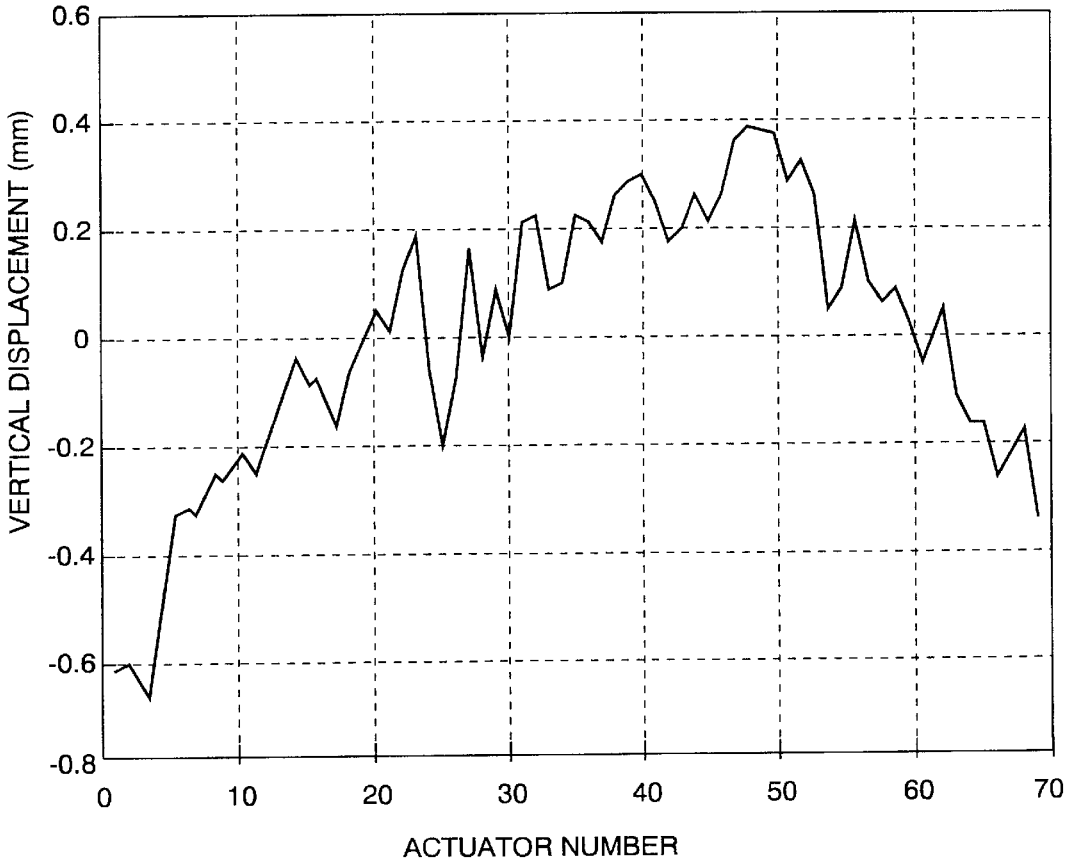

FIG. 2 shows an actuator set point profile illustrating the positions of the actuators 1*a* for adjusting the slice of the head box 1. The set point of each actuator is determined e.g. by governing such set points or by measuring said set points. Governing and determining the set points are fully known per se to those skilled in the art and are therefore not described in any more detail here. Point 0 on the Y axis corresponds to an average or reference opening of the slice and the vertical displacement represents the displacement from said value in the exemplary case. in FIG. 2, the reference value for the slice opening is 7 mm.

Figure 3:
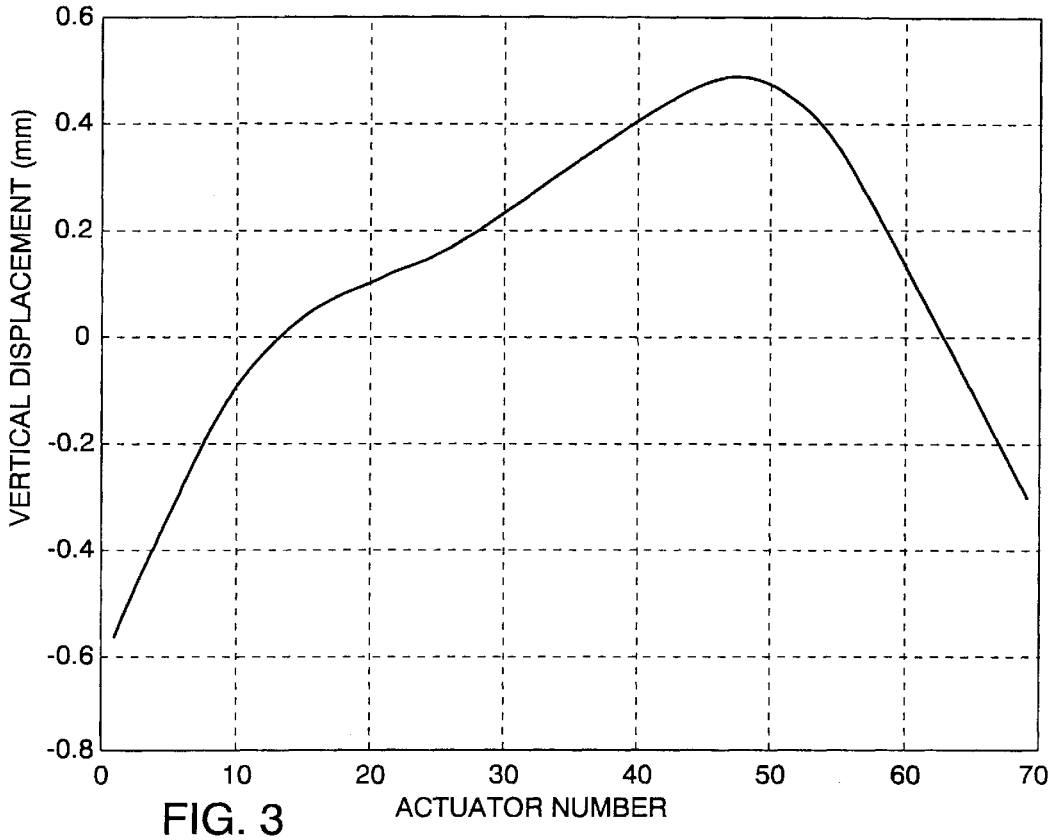
FIG. 3 shows the profile of FIG. 2 filtered, and FIG. 4 schematically shows the shrinkage nonlinearity in the case shown in FIG. 2.

FIG. 3 shows the profile of FIG. 2, from which high frequencies, i.e. short wavelengths, have been filtered. The filtering can be implemented by any filtering solution known per se, fully known to those skilled in the art and therefore not described in any more detail here.

Figure 4:
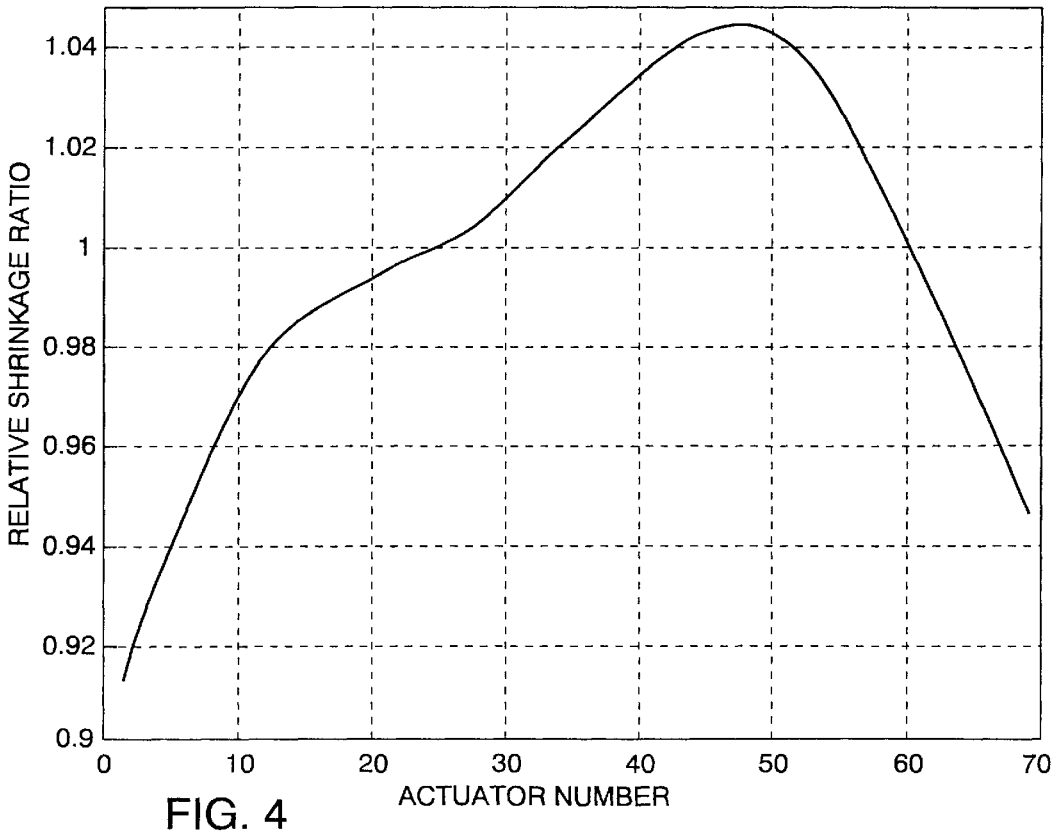

The shrinkage nonlinearity, schematically shown in FIG. 4, can be deduced from the filtered profile of FIG. 3. The relative shrinkage ratio defined at each actuator corresponds fairly exactly to the filtered set point profile. The mapping can be deduced from the shrinkage nonlinearity in a manner known per se.

The actuator set point profiles from which the shrinkage nonlinearity is deduced, can be e.g. headbox dilution valve profiles, headbox slice lip profiles or pressure profiles for steamboxes in the wire or press sections of paper machines.

An upper limit on tolerable mapping error is approximately one half of the distance between actuator elements. Since some cross machine actuators are governed largely to counteract the effects of shrinkage, it follows that patterns in such actuators at wavelengths longer than the maximum possible mapping error will reveal the shrinkage profile in the machine. In some cases actuator set point patterns involving wavelengths shorter than four times the maximum existing mapping error are dominated by effects of the error, but actuator set point patterns involving wavelengths longer than about eight times the maximum existing mapping error are substantially unaffected by the mapping error, and thus correspond to patterns in the shrinkage.

One aspect of the present invention is to identify the shrinkage nonlinearity from patterns in actuator set point profiles. Said actuators may be governed either by manual or automated means.

Another aspect of the present invention is to operate a cross machine control system such that it starts using one mapping relation and subsequently modifies that mapping relation based on the shrinkage nonlinearity inferred from observation of patterns in a cross machine actuator set point profile. In this case the cross machine actuator which is modulated by the cross machine control system need not be the same as the cross machine actuator from which the shrinkage nonlinearity is identified.

This method of operation causes the mapping in use by the control system to progressively increase in accuracy, without disturbance to the process. This method of operation also allows a control system to operate initially with a mapping which would not normally be considered sufficiently accurate, but to progressively improve that mapping during operation. Improvement in mapping accuracy leads to increased efficacy of the control system. In turn, this allows further improvement in mapping accuracy, since a shorter wavelength can be used in subsequent determination of shrinkage nonlinearity. A virtuous circle of continuous improvement thereby results, between the mapping identification and the control operation.

When the maximum mapping error becomes less than about one quarter of the distance between actuators, then the cutoff wavelength for the filter becomes shorter than the Nyquist wavelength of the actuators. In this particular case, the actuator set point profile can be considered to be suitably filtered already, and no additional filtering is needed.

Yet another aspect of the present invention is to deduce the relative differences in shrinkage for subsections of the sheet in the cross machine direction. In this aspect, it is not necessary to consider the entire actuator set point profile, but merely the subsections of the set point profile corresponding to the cross machine subsections of interest. It is also possible to apply different filtering to different sections of the actuator set point profile as per need. Further, for example, set points of actuators corresponding to trimmed-off sections of the web can be discarded.

The drawing and the related description are only intended to illustrate the idea of the invention. The details of the invention may vary within the scope of the claims.

We claim:

1. A method of defining the cross-directional properties of a sheet in a continuous sheet making process, the method comprising the steps of defining a set point profile of the actuators affecting the cross-directional properties of the sheet, filtering high frequencies from the profile, and deducing a shrinkage nonlinearity from the filtered profile.

2. A method as claimed in claim 1, the method further comprising the step of deducing mapping from shrinkage nonlinearity.

3. A method as claimed in claim 1, wherein wavelengths shorter than four times a maximum existing mapping error are filtered from the set point profile.

4. A method as claimed in claim 1, wherein wavelengths shorter than eight times a maximum existing mapping error are filtered from the set point profile.

5. A method as claimed in claim 1, wherein set points of actuators corresponding to trimmed-off web sections are discarded.

6. A method as claimed in claim 1, wherein set points of actuators in disjoint sections of the actuator set point profile are used, and wherein filtering and deduction of shrinkage nonlinearity are performed separately for each section.

7. A method as claimed in claim 6, wherein different filtering is applied to different sections of the actuator set point profile.

8. An equipment for defining the cross-directional properties of a sheet in a continuous sheet making process, the equipment comprising actuators for adjusting the cross-directional properties of the sheet, means for defining a set point profile of the actuators, means for filtering high frequencies from the set point profile, and means for deducing a shrinkage nonlinear ity from the filtered set point profile.

9. An equipment as claimed in claim 8, the equipment further comprising means for deducing mapping from the shrinkage nonlinearity.

10. An equipment as claimed in claim 8, the equipment comprising means for filtering wavelengths shorter than four times a maximum existing mapping error from the set point profile.

11. An equipment as claimed in claim 8, the equipment comprising means for filtering wavelengths shorter than eight times a maximum existing mapping error from the set point profile.

12. An equipment as claimed in claim 8, the equipment comprising means for defining the set point profile of the actuators in disjoint sections, means for filtering each section separately and means for deducing shrinkage nonlinearity for each section separately.

13. An equipment as claimed in claim 12, wherein the filtering means are arranged to apply different filtering to different sections of the actuator set point profile.

* * * * *